US008671651B2

(12) United States Patent
Poutot

(10) Patent No.: US 8,671,651 B2
(45) Date of Patent: Mar. 18, 2014

(54) PACKAGING MACHINE AND METHOD OF PACKAGING ARTICLES

(75) Inventor: Benoit Poutot, Chateauroux (FR)

(73) Assignee: Meadwestvaco Packaging Systems, LLC, Richmond, VA (US)

( * ) Notice: Subject to any disclaimer, the term of this patent is extended or adjusted under 35 U.S.C. 154(b) by 543 days.

(21) Appl. No.: 13/002,550

(22) PCT Filed: Jul. 2, 2009

(86) PCT No.: PCT/US2009/049557
§ 371 (c)(1),
(2), (4) Date: Mar. 5, 2011

(87) PCT Pub. No.: WO2010/003083
PCT Pub. Date: Jan. 7, 2010

(65) Prior Publication Data

US 2011/0154784 A1 Jun. 30, 2011

(30) Foreign Application Priority Data

Jul. 4, 2008 (GB) ..... 0812233.5

(51) Int. Cl.
*B65B 21/24* (2006.01)
*B65B 43/28* (2006.01)
*B65B 5/02* (2006.01)
*B31B 5/00* (2006.01)

(52) U.S. Cl.
USPC ..... 53/398; 53/48.7

(58) Field of Classification Search
CPC B31B 2241/001; B65B 21/242; B65B 21/24; B65B 43/285; B65B 5/105; B65B 5/024
USPC ..... 53/397, 398, 48.6–48.9, 580
See application file for complete search history.

(56) References Cited

U.S. PATENT DOCUMENTS

| | | | | |
|---|---|---|---|---|
| 3,187,479 | A | 6/1965 | Ganz | |
| 3,323,275 | A * | 6/1967 | Kingsbury et al. | 53/462 |
| 3,491,508 | A | 1/1970 | Standley | |
| 3,550,754 | A | 12/1970 | Ganz | |
| 3,557,521 | A * | 1/1971 | Pierce, Jr. | 53/398 |
| 3,747,294 | A * | 7/1973 | Calvert et al. | 53/48.1 |
| 3,805,484 | A | 4/1974 | Rossi | |
| 3,940,907 | A * | 3/1976 | Ganz | 53/48.7 |
| 5,626,002 | A * | 5/1997 | Ford et al. | 53/398 |
| 5,673,536 | A * | 10/1997 | Easter et al. | 53/398 |
| 2002/0083680 | A1 * | 7/2002 | Duperray et al. | 53/398 |
| 2004/0068961 | A1 * | 4/2004 | Chalendar et al. | 53/398 |
| 2006/0042188 | A1 | 3/2006 | Ford | |

FOREIGN PATENT DOCUMENTS

| | | | | |
|---|---|---|---|---|
| WO | WO 9313987 A1 * | 7/1993 | | 53/398 |
| WO | WO 03024803 A2 * | 3/2003 | | B65B 21/24 |

* cited by examiner

*Primary Examiner* — Stephen F Gerrity
(74) *Attorney, Agent, or Firm* — MWV Intellectual Property Group

(57) ABSTRACT

A packaging machine (10) comprising two or more packaging subsystems each capable of packaging articles (A) into a carton, wherein the packaging subsystems share a common source of articles (11) to be packaged and at least one transfer mechanism 5 (22) is provided for transferring articles (A) from the common source to any of the two or more packaging subsystems.

8 Claims, 11 Drawing Sheets

PACKAGING MACHINE AND METHOD OF PACKAGING ARTICLES

FIELD OF THE INVENTION

The present invention relates to a packaging machine and a method of packaging articles. More particularly, but not exclusively, the invention relates to a method of manipulating articles in a stream of articles and an apparatus for carrying out the method and to a packaging machine having a layout which is capable of processing multiple carton types and formats.

BACKGROUND OF THE INVENTION

In the field of packaging it is often required to provide consumers with a package comprising multiple primary product containers, such multi-packs are desirable for shipping and distribution and for display of promotional information.

It is known to automate packaging of the primary product containers into the package by placing the primary product containers into a carton formed from a carton blank.

It is also desirable to produce packaging machine which can be coupled to the output of a processing machine which places product into the primary product containers, for example this may be a bottling or canning machine. It may be further desirable to reorganise the output stream of primary product containers to facilitate placement into cartons.

A further objective of the present invention is to provide a packaging machine having a layout which is capable of processing a variety of different carton formats; for example: wrap around carton, basket carriers, fully enclosed cartons, and to be able to side or end load, top load or bottom load the chosen carton format with primary product containers. Furthermore it is desirable to be able to rapidly change the format or layout of the packaging machine to adapt to the carton format or loading method required.

It is also desirable to produce a packaging machine which can place the packages containing the primary product containers into a further package for shipping and distribution of the multi-packs.

It is also desirable to place the primary product containers in a loose format into the tertiary package such that the primary product containers can be distributed individually by a retailer to a consumer.

SUMMARY OF INVENTION

According to a first aspect of the present invention there is provided a packaging subsystem for application of a carton blank to one or more articles which packaging subsystem comprises a carton hopper for holding carton blanks, a feeder mechanism for removing carton blanks from the hopper and placing them on a first conveyor, folding mechanism for folding the panels of the carton blank about the first conveyor and a transfer mechanism for picking up, in a substantially inverted U shape, and placing the folded carton blank about one or more articles being transferred on a second conveyor.

Preferably, either the first or second conveyor or both first and second conveyors are continuously moving.

Preferably, the second conveyor is parallel to said first conveyor.

According to a second aspect of the present invention there is provided a packaging subsystem for arranging an input stream of articles comprising at least one lane or column of articles, wherein the subsystem comprises an article pick and place robot for picking up one or more articles from stream of articles and placing them on a conveyor, the pick and place robot comprising an arm pivotally mounted above the conveyor and a gripper head pivotally coupled to the arm, an article retardation mechanism is provided for slowing articles upon the conveyor wherein a stream of articles is output from the subsystem which has been arranged such that it comprises at least one more column or lane of articles than the input stream of articles.

Preferably, the input stream of articles comprises two lanes and output stream of articles comprises four lanes of articles.

Preferably, the input stream of articles comprises two lanes and output stream of article comprises three lanes of articles.

Preferably, the retardation device comprises at least one lug coupled to an endless conveyor which lug is inserted into the stream of articles downstream of the pick and place robot.

According to a third aspect of the present invention there is provided a packaging machine comprising the subsystems hereinbefore described.

According to a fourth aspect of the present invention there is provided a packaging machine comprising an article conveyor for providing a stream of articles to be packaged, a first hopper for storing first carton blanks, a second carton hopper for storing second carton blanks, a first feeder mechanism for placing the first carton blanks on a first conveyor and a second feeder mechanism for placing the second carton blanks on a second conveyor and a third conveyor for receiving grouped articles from the input conveyor and at least one transfer device capable of moving articles from the input conveyor to either the first or third conveyor such that the articles may be packaged in the first or second blank respectively.

Preferably, the packaging machine further comprises a second transfer mechanism capable of transferring articles between the input conveyor and the first conveyor or carton blanks between said second conveyor and the third conveyor.

Preferably, the first or second transfer mechanisms comprise interchangeable head units allowing them to handle different carton types or articles and/or to switch between transferring articles and cartons.

According to a fifth aspect of the present invention there is provided a packaging machine comprising two or more packaging subsystems each capable of packaging articles into a carton, wherein the packaging subsystems share a common source of articles to be packaged and at least one transfer mechanism is provided for transferring articles from the common source to any of the two or more packaging subsystems.

Preferably, each of the two packaging subsystems packages articles into different carton types or formats.

Preferably, the cartons processed by one packaging subsystem of said two or more packaging subsystems are placed into the cartons processed by another packaging subsystem of said two or more packaging subsystems.

According to a sixth aspect of the present invention there is provided a method of continuously forming a package comprising:

- providing a continuous stream of carton blanks upon a first conveyor,
- providing a continuous stream of articles upon a second conveyor,
- folding said carton blanks about the first conveyor into an inverted U-Shaped structure,
- sequentially picking up at least one of said inverted U-shaped structures and placing it about one or more articles upon the second conveyor,
- folding panels of the carton blank to complete construction of a carton about the group of articles to form a continuous stream of packages.

Preferably, said carton blanks are continuously moving during formation of the package.

Preferably, said articles are continuously moving during formation of the package.

According to a seventh aspect of the present invention there is provided a method of manipulating articles in a stream of articles comprising:

providing a continuous input stream of articles comprising at least one column of articles upon a conveyor comprising at least one more lane than columns of articles, picking up at least one article from at least one of said columns of articles, placing said picked up at least one article into a vacant one of said at least one more lanes, retarding articles in all of said at least one more lanes such that a continuous output stream of articles comprising at least one more column than the input stream is created.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS OF THE PRESENT INVENTION

Figure 1:
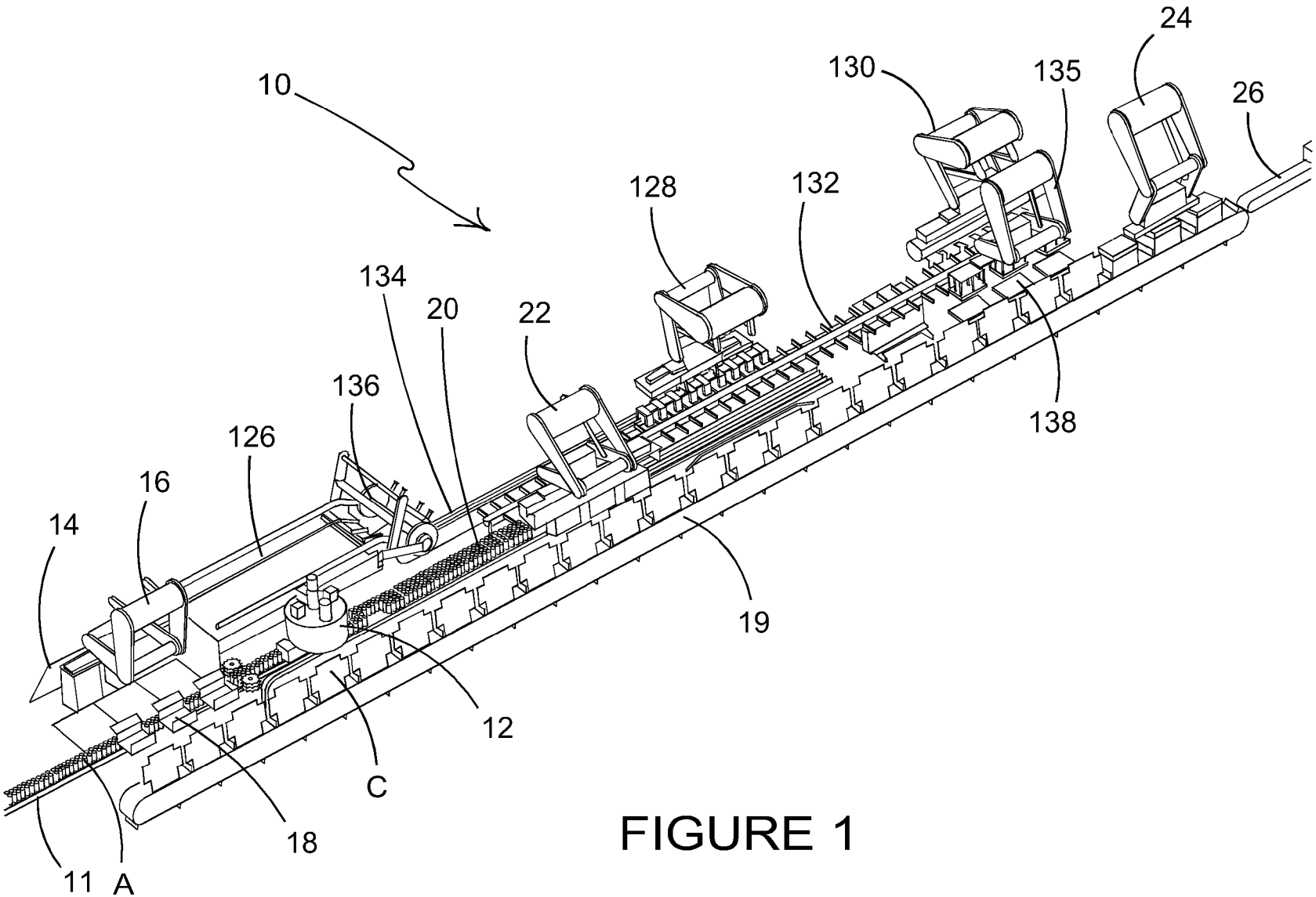
FIG. 1. is a perspective view from above of a packaging machine according to a first embodiment of the invention.

Referring to FIG. 1 there is shown a perspective view of a packaging machine 10 capable of accepting an input of primary products, such as, but not limited to, bottles or cans, hereinafter referred to as articles.

Articles A are transferred in a stream to the input end of the packaging machine 10 on an input conveyor 11. Carton blanks B are stored in a hopper or magazine 14 and transferred from the hopper 14 to a carton conveyor 19 via a pre-former 18 by a carton blank feeder mechanism 16. The carton blank feeder mechanism 16 picks up a carton blank B from the hopper 14, in a first embodiment three carton blanks B are picked up simultaneously, the carton blank B is pushed into the pre-former 18 by the carton blank feeder mechanism 16. The pre-former 18 forces the side panels and end panels of the carton blank B to be folded into a substantially perpendicular relationship to one another and to a base panel of the carton blank B, thus partially forming a carton C from the carton blank B. The partially formed carton C is capable of receiving articles A prior to completing assembly of the carton C.

The carton blank feeder mechanism 16 removes the partially assembled carton C from the pre-former 18 and places them on the carton conveyer 19. The carton conveyor 19 is disposed alongside and substantially parallel to the input conveyor 11.

The stream of articles A may then be rearranged by an article manipulator 12, to be described in more detail below, before being transferred to a carton filling station where they are picked up by a carton filler device 22 and placed into the partially assembled carton C. The filled cartons C are then transferred to a closing station where a carton closer 24 folds the top panel of the carton C into position and folds and secures top end flaps to one of the side panels and the end panels of the carton C respectively. The fully assembled packages are then transferred from the packaging machine 10 for further processing (not shown) by an output conveyor 26.

Figure 2:
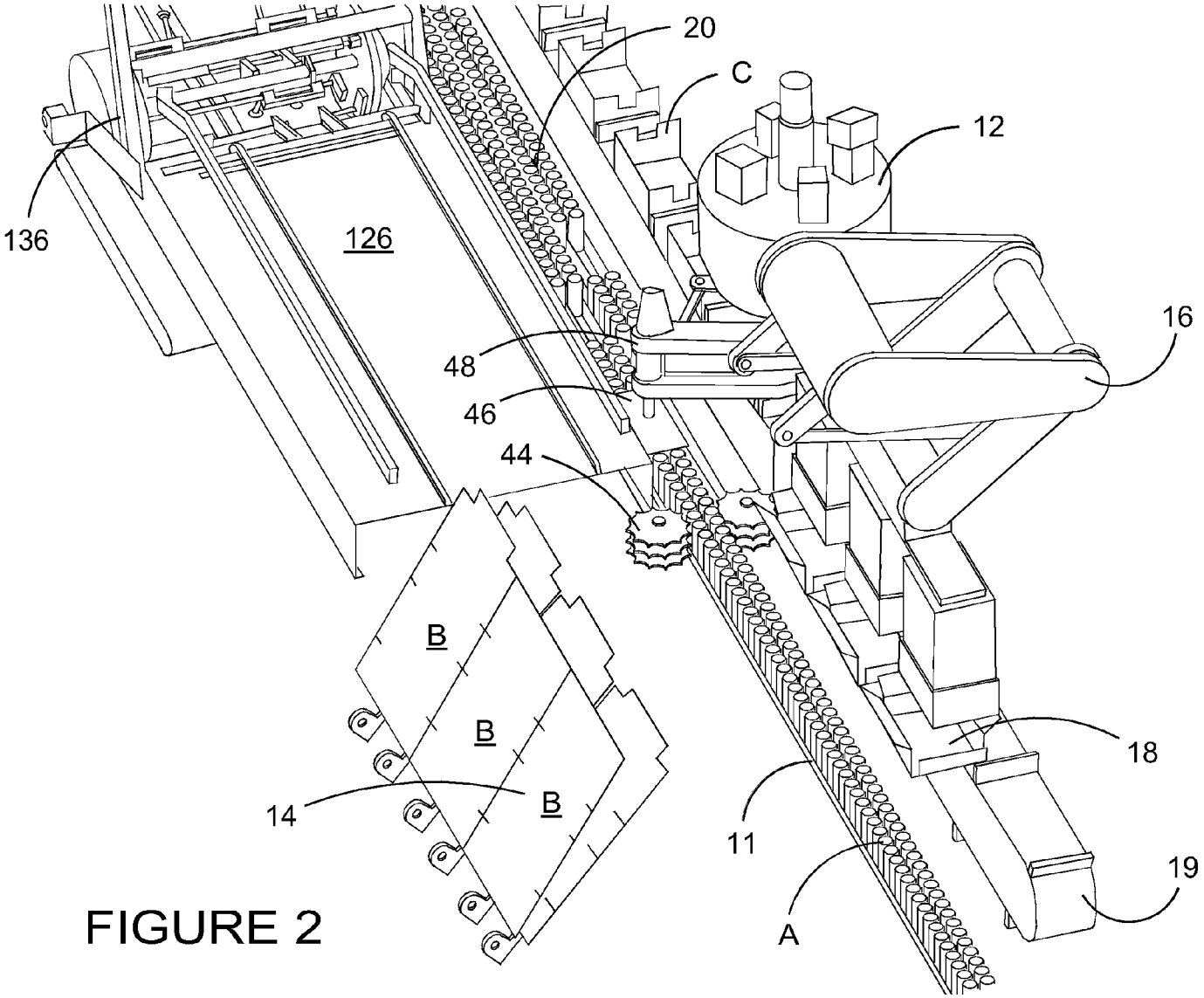
FIG. 2. is a perspective view from above of subsystem at the input end of the packaging machine of FIG. 1 at a first stage of a first mode of operation.
Figure 3:
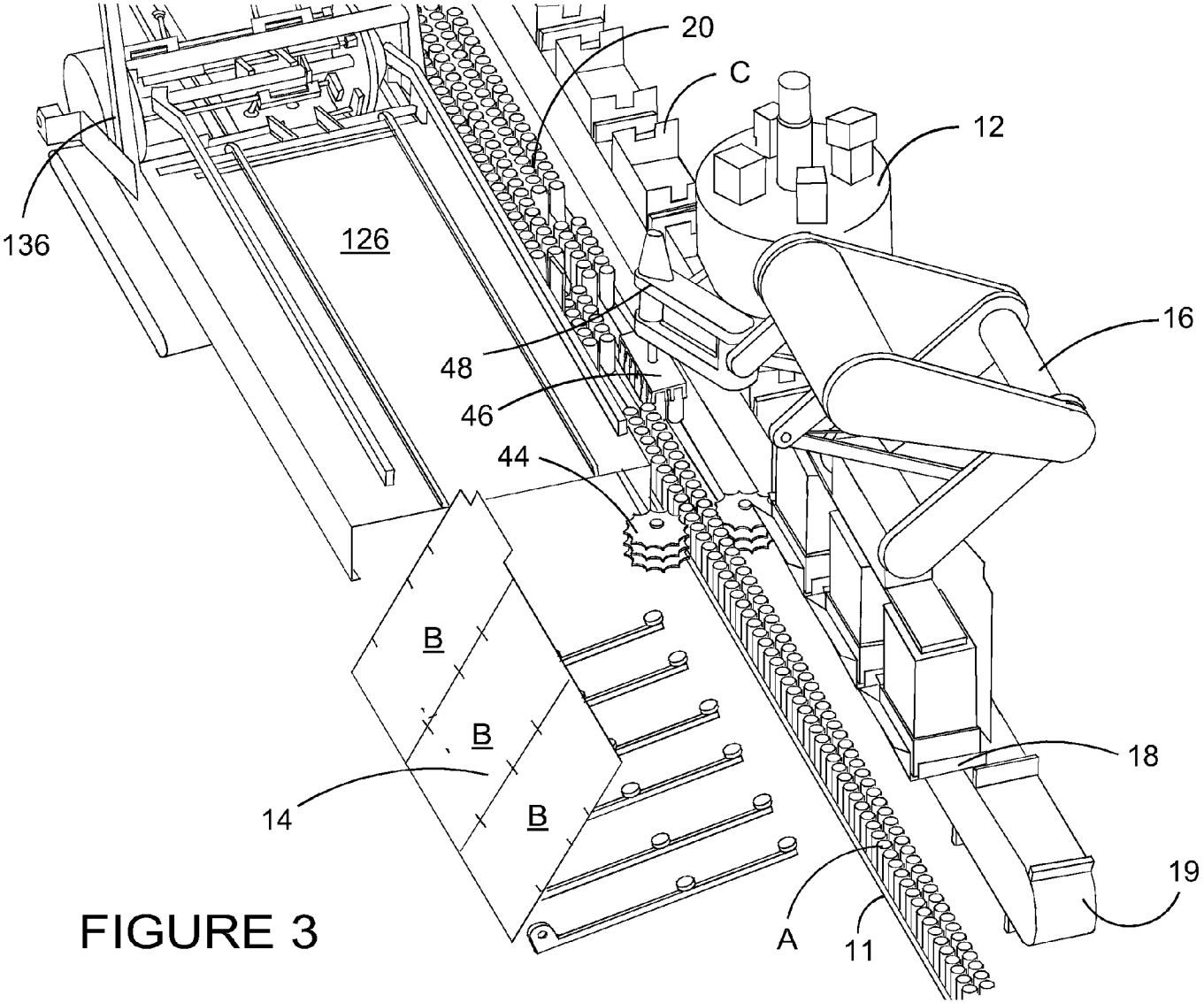
FIG. 3. is a perspective view from above of subsystem FIG. 2 at a second stage of a first mode of operation.

Turning in more detail to the article manipulator 12, FIGS. 2 and 3 illustrate operation of the article manipulator 12 in a first mode of operation, in this mode of operation the article manipulator 12 converts the input stream of articles A from two lanes of articles A into four lanes of articles A.

The article manipulator 12 comprises an arm 48 pivotally mounted overhead of the input stream of articles A. The arm 48 is pivotally coupled to a gripper head 46 which in this embodiment is capable of grasping twelve articles A, a drive means is provided to reciprocally rotate the arm above the input stream of articles A, a further drive means is provided to maintain the gripper head 46 in parallel orientation, when viewed from above, with the input conveyor 11, it envisaged that separate drive mechanisms may be provided for both functions or that a single drive mechanism may be used. It is anticipated that the drive mechanism may be provided by a servo motor or other suitable electric motor; however in alternative embodiments a hydraulic or pneumatic mechanism may be used.

Changing the number of lanes or columns of articles A in the stream of articles A is achieved by picking up six articles A from each of the two input lanes and placing them in two additional lanes as shown in FIGS. 2 and 3. The article manipulator 12 allows the subsequent six articles A in each of the two input lanes to pass by unhindered. The article manipulator 12 then picks up twelve further articles A following the twelve unhindered articles A and places them in the two additional lanes.

Figure 4:
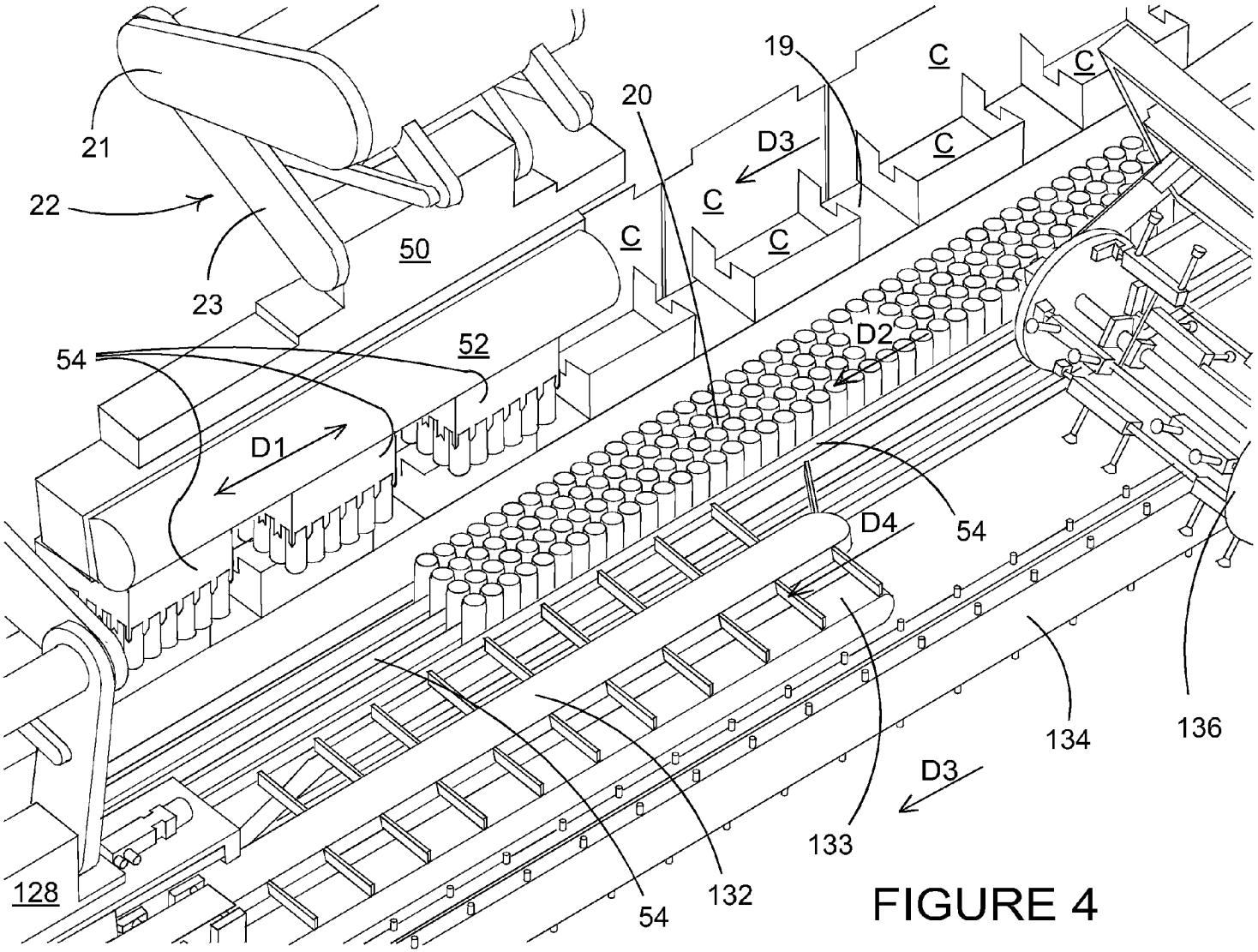
FIG. 4. is a perspective view from above of a carton filling station of the packaging machine of FIG. 1 in the first mode of operation.

In order to provide a continuous stream of articles A comprising four lanes of articles A it is necessary to retard the articles A downstream of the article manipulator 12. This is achieved by introducing retardation lugs 56 into the reorganised stream 20 of articles A. The retardation lugs 56 are coupled to and endless conveyor disposed beneath the reorganised stream 20 of article A, as shown in FIG. 4. The retardation lugs 56 move in the same direction as that of the articles A but at a slower speed than the conveyor 11 transferring the articles A. In this way when the articles A engage with the retardation lugs 56 they are slowed down, subsequent articles A in the stream 20 are also slowed down as they meet those slower downstream articles A. In this way the unhindered articles A and the transferred articles A form a continuous stream 20 of articles A comprising four lanes of articles A.

Preferably the packaging machine 10 comprises a pair of star wheels 44 disposed on either side of the input stream of articles A. The star wheels 44 regulate the flow of articles A and ensure that they are evenly spaced as shown in FIGS. 2 and 3. This facilitates picking up of the articles A by the gripper head 46.

Referring again to FIG. 4 the articles A in the reorganised stream 20 comprising four lanes are picked up by a carton filler 22. Carton filler 22 comprises an upper arm 21 and a lower arm 23 pivotally coupled to one another. The lower arm 23 is pivotally coupled to a coupling head 50, the coupling head 50 is mounted to a moving head mechanism 52 which in turn is coupled to gripper heads 54. The upper arm 21 is also pivotally coupled to a frame (not shown).

In the embodiment shown in FIG. 4 three gripper heads 54 are provided, each capable of picking up twenty-four articles A in a 4×6 array. The gripper heads 54 are also capable of moving with respect to each other such that they can pick up articles A in groups which are in contact with each other when on the conveyor 11 and space them a part to match the spacing and pitch of the cartons C on the carton conveyor 19.

The moving head mechanism 52 is capable of being moved reciprocally in a linear motion a direction D1 which is substantially parallel to the input conveyor 11 and carton conveyor 19, moving head 52 is therefore capable of moving upstream and downstream within the packaging machine 10. This allows the carton filler subsystem 22 to pick up articles from the input conveyor 11 at a first position in the packaging machine 10 and place them in a carton C disposed at a second position downstream of the first position. In this way the input stream of articles A and the reorganised stream 20 of articles A can be continuously moving downstream in the direction indicated by direction arrow D2. The moving head mechanism 52 is described in more detail in co-pending UK application GB 0812201.2 filed on 4 Jul. 2008 the contents of which application are incorporated in the present application.

In this embodiment the cartons Care transferred in a direction D3 which is the same as the direction D2 which the articles A are moved, however it is envisaged that the cartons C and articles A could be transferred in opposite directions by, for example, inputting the stream of articles A at the opposite end of the packaging machine 10.

Figure 5:
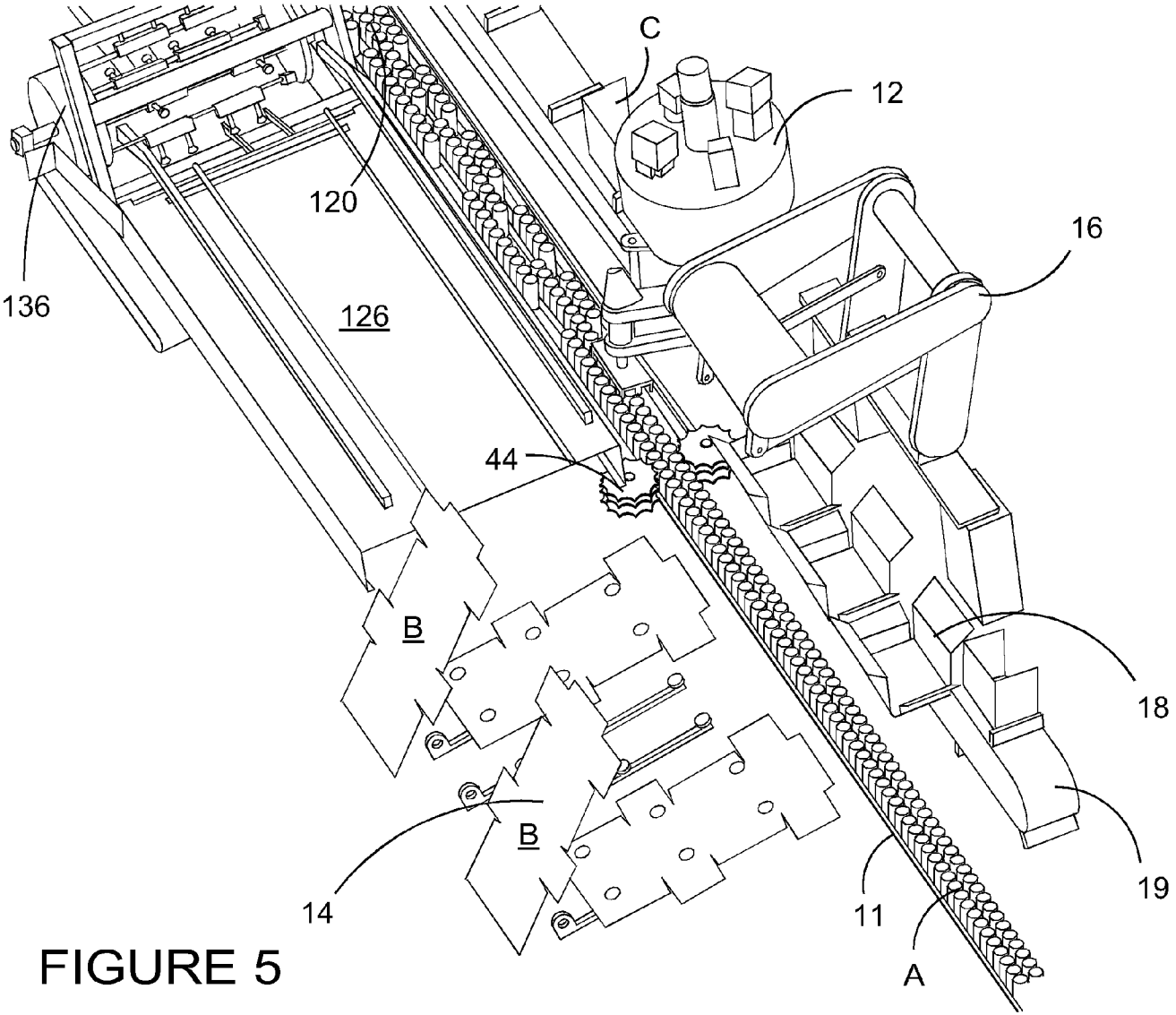
FIG. 5. is a perspective view from above of the subsystem at the input end of the packaging machine of FIG. 1 at a first stage of a second mode of operation FIG. 6. is a perspective view from above of subsystem of FIG. 5 at a second stage of a second mode of operation.
Figure 6:
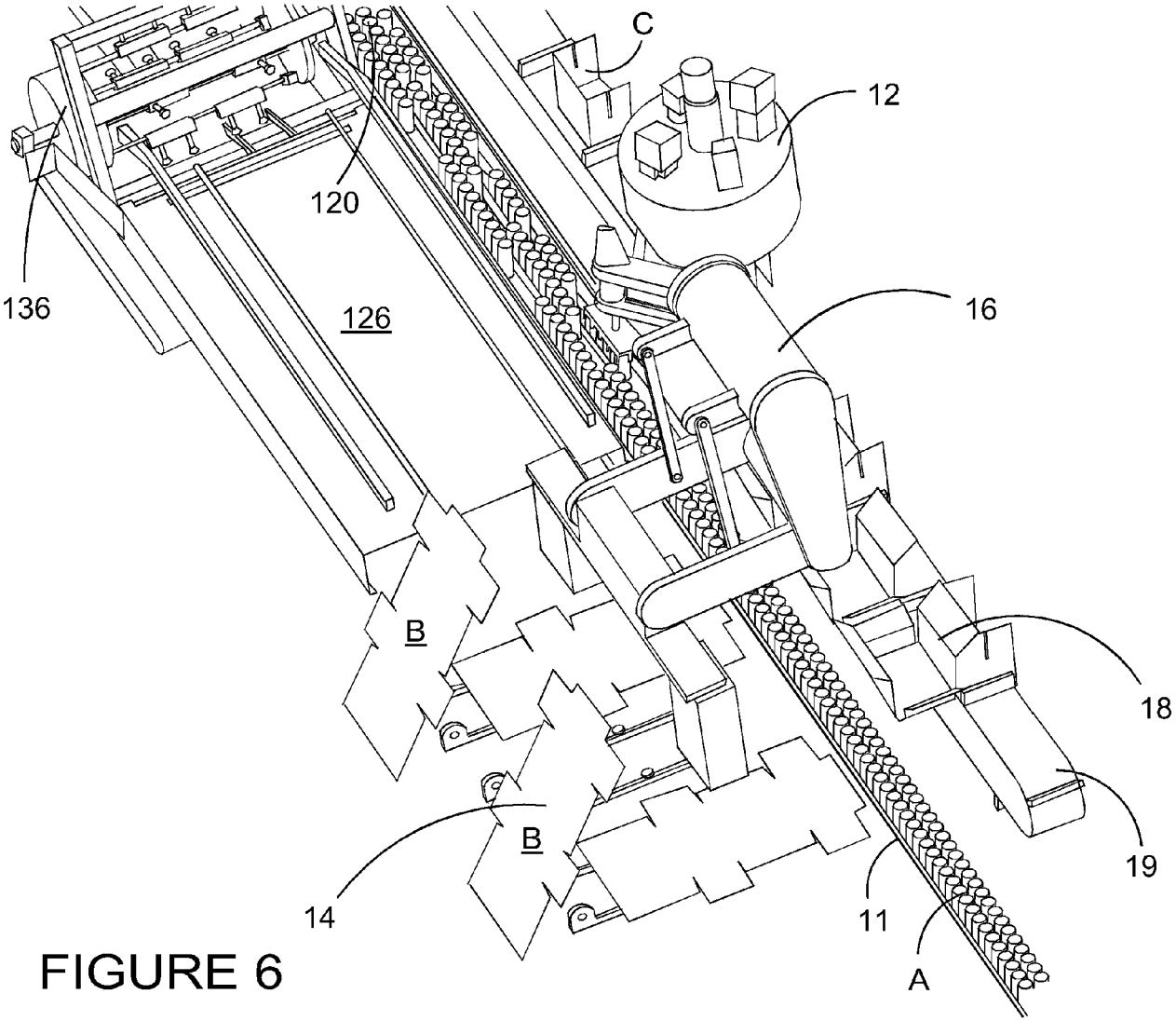

FIG. 5 illustrates a second mode of operation of the packaging machine 10 in which the input stream of articles A is reorganised into a stream 120 of three lanes from the input stream of articles A having two lanes. Again star wheels 44 are provide to regulate the flow and spacing input stream of articles A. In this second mode of operation, the article manipulator 12 alternates between (1) Picking up a single column of five articles A from one of the input lanes and placing it into an additional third lane as shown in FIGS. 5 and 6 such that a vacant space having a length equivalent to the diameter of the five removed articles A is created in a central lane.

Figure 7:
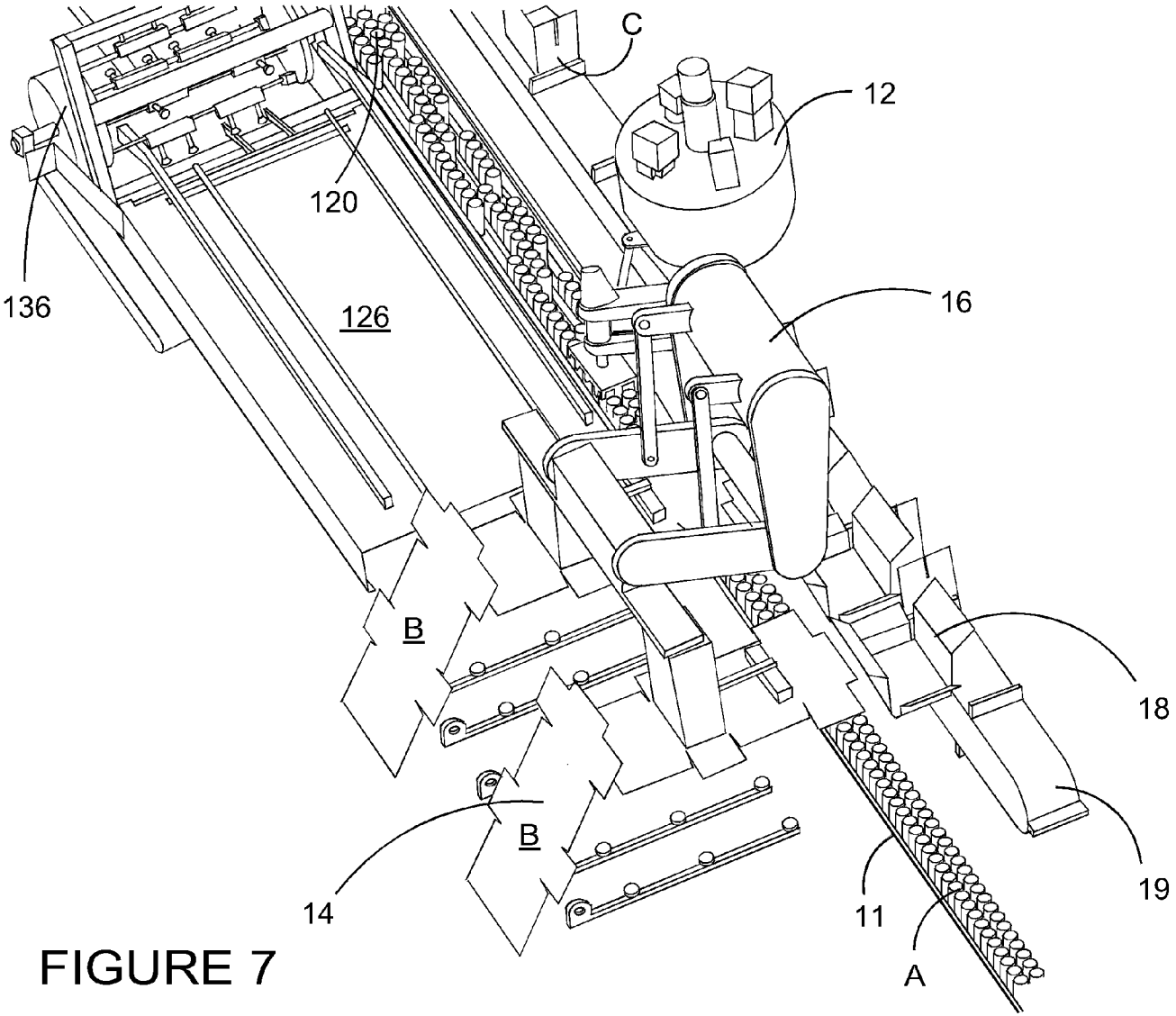
FIG. 7. is a perspective view from above of subsystem of FIG. 5 at a third stage of a second mode of operation.
Figure 8:
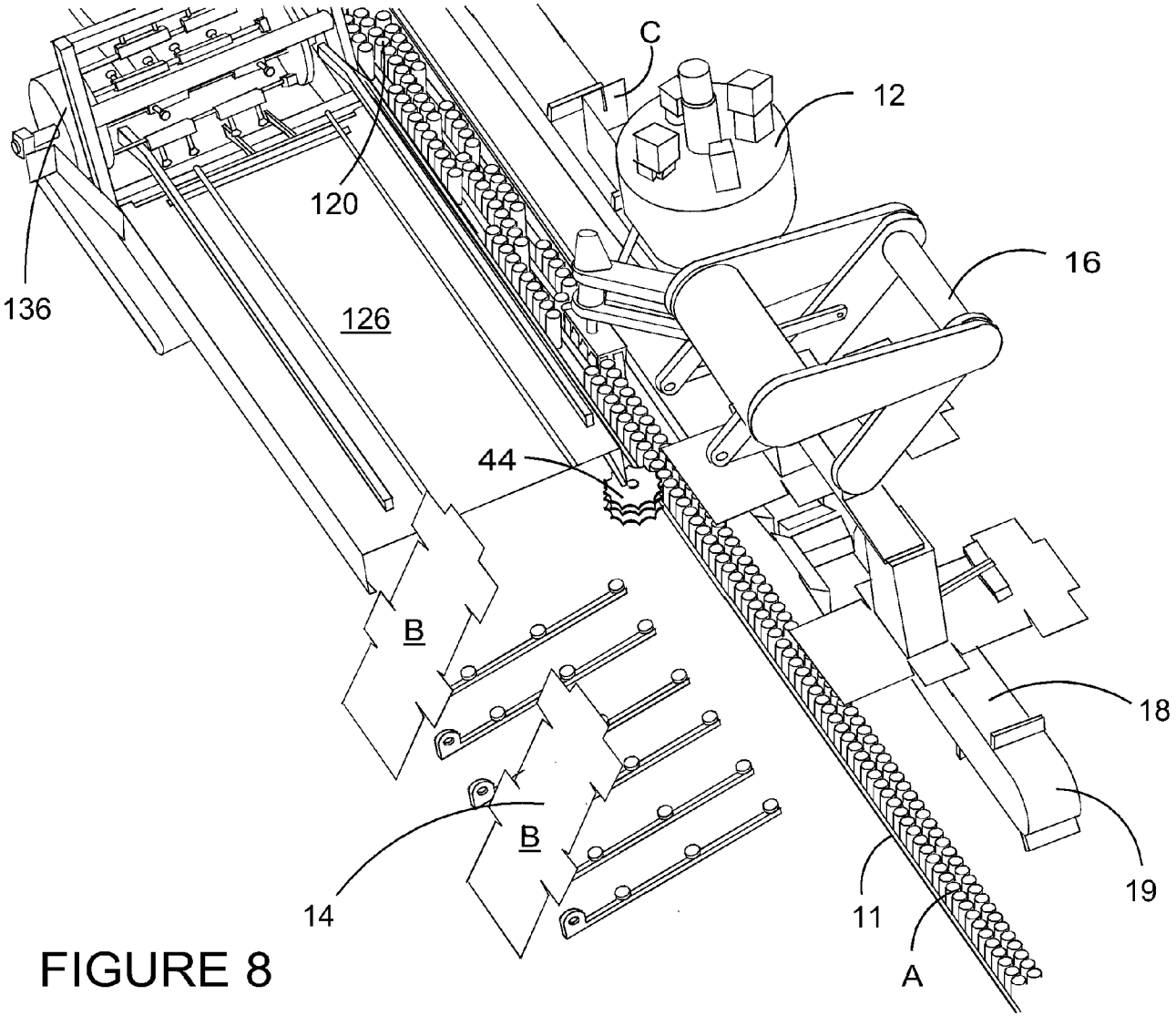
FIG. 8. is a perspective view from above of subsystem of FIG. 5 at a fourth stage of a second mode of operation.

(2) Picking up a group of ten articles A in two columns of five articles A such that five articles A are picked up from each of the two input lanes and placing them such that a first one of the columns of five articles A picked up is placed in the additional third lane and the other, second, column of five articles A is placed in the lane where the said first one column was picked up from, as shown in FIGS. 7 and 8.

Figure 9:
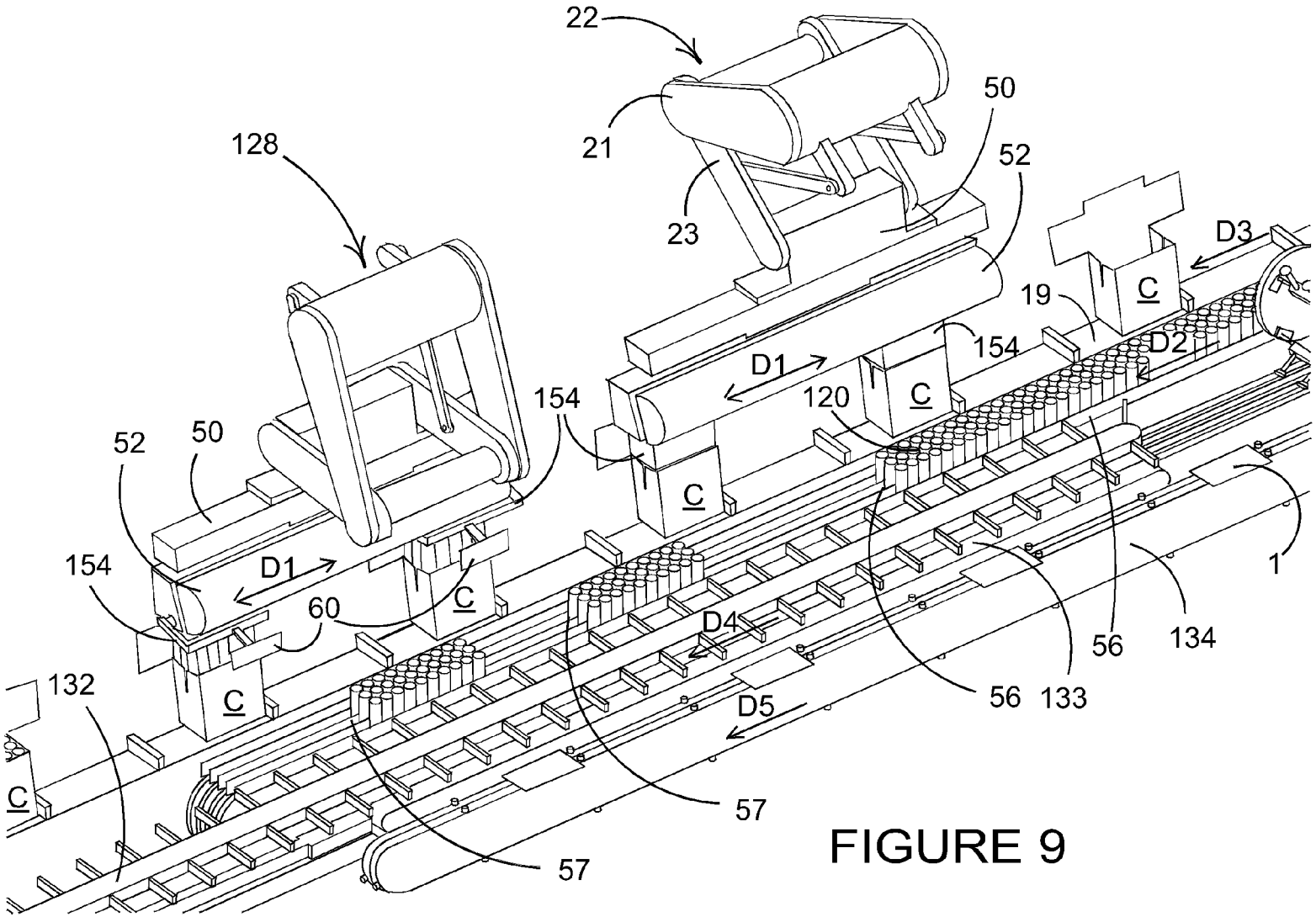
FIG. 9. is a perspective view from above of a carton filling station of the packaging machine of FIG. 1 in the second mode of operation.

Again the articles A are retarded downstream of the article manipulation device 12 such that the articles A reform into a continuous stream 120 of three lanes of articles A, the retardation lugs 56 as shown in FIG. 9 provides a retardation or deceleration to the articles A which they come into contact with similarly subsequent upstream articles A are retarded by the slower moving downstream articles A. It is envisaged that in alternative embodiments the retardation lug 56 may be replaced by a flight bar as known in the art, or that the retardation lugs 56 may be provided coupled to an overhead conveyor.

Optionally, in this second mode of operation two carton fillers 22, 128 may be provided in place of the single carton filler 22 described previously as illustrated in FIG. 9. A first carton filler 22 picks up two groups of fifteen articles A, arranged in an array of 3×5, with a respective gripper head 154 and places each of the groups onto the base panel of a respective carton C.

The first carton filler 22 allows a two groups of fifteen articles A, thirty articles A in total, adjacent the retardation lug 56 to pass unhindered and selects a second group of thirty articles A upstream of the first two unhindered groups of fifteen articles A to pick up and group into two groups of fifteen articles A and places each group of fifteen articles A into a respective carton C.

Again the gripper heads 154 are capable of movement with respect to one another to allow the gripper heads 154 to generate the article groups and bring each group into registry with the respective carton C being filled.

As before, the carton filler 22 comprises a moving head mechanism 52 allowing the carton filler 22 to collect articles A from an upstream location and deposit them in a downstream location.

The first group of thirty articles A which passed the carton filler 22 unhindered are transferred on the conveyor 11 to a second carton filler 128. The first group of thirty articles A then engage with a second article retardation device having lugs 57 which completes the transfer of the articles A to the second carton filler 128. Optionally, the second article retardation device is capable of engaging more than one group of thirty articles A at a time; in this embodiment the second article retardation device engages two groups at a time and may comprise two sets of lugs 57.

Carton filler 128 is similar in structure to the first carton filler 22, optionally it may additionally comprise an insert gripper 60 for picking up and placing inserts I into the cartons C.

Inserts I are stored in a hopper or magazine 126 as shown in FIG. 1, the inserts I are fed onto a insert conveyor 134 by an insert feeder mechanism 136. The inset conveyor 134 conveys the inserts I to the filling station to be picked up by the second carton filler 128. The second carton filler 128 picks up the inserts I from the insert conveyor 134 and then picks up the leading group of thirty articles A which passed the first carton filler 22, the second carton filler 128 then groups the articles A into two groups of fifteen articles A arranged in a 3×5 array. The second carton filler 128 then places the inserts I into the cartons C, which were partially filled by the first carton filler 22, on top of the first layer of articles A deposited within the carton C by the first carton filler 22. The second carton filler 128 then places a group of fifteen articles A into the carton C to form a second layer on top of the insert I.

The cartons C are then closed by the carton closer 24 as shown in FIG. 1 and transferred for further processing by the output conveyor 26 as previously described.

Figure 10:
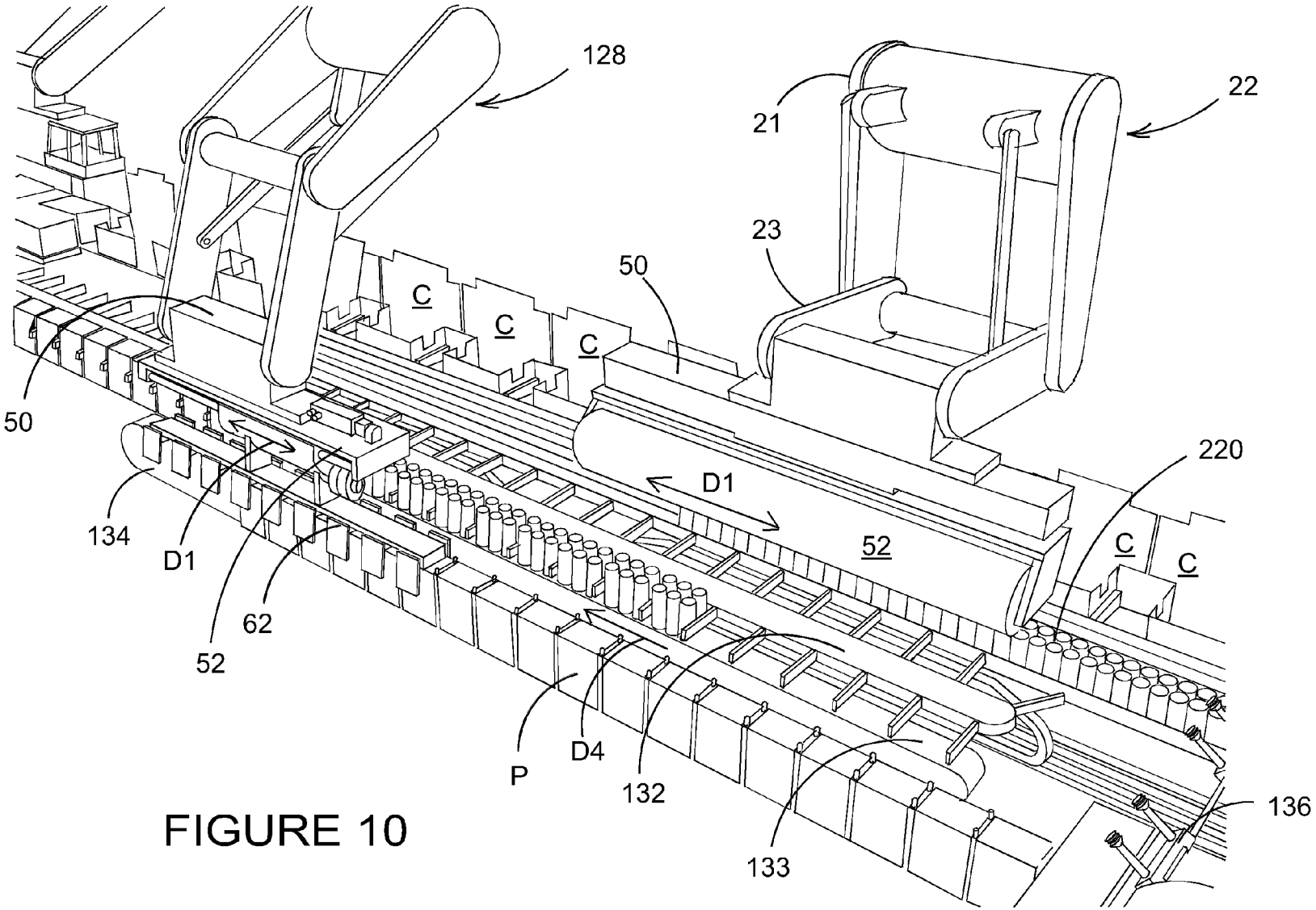
FIG. 10. is a perspective view from above of the carton filling stations of FIG. 4 and FIG. 9 to a second embodiment of the invention in a first stage of operation.
Figure 11:
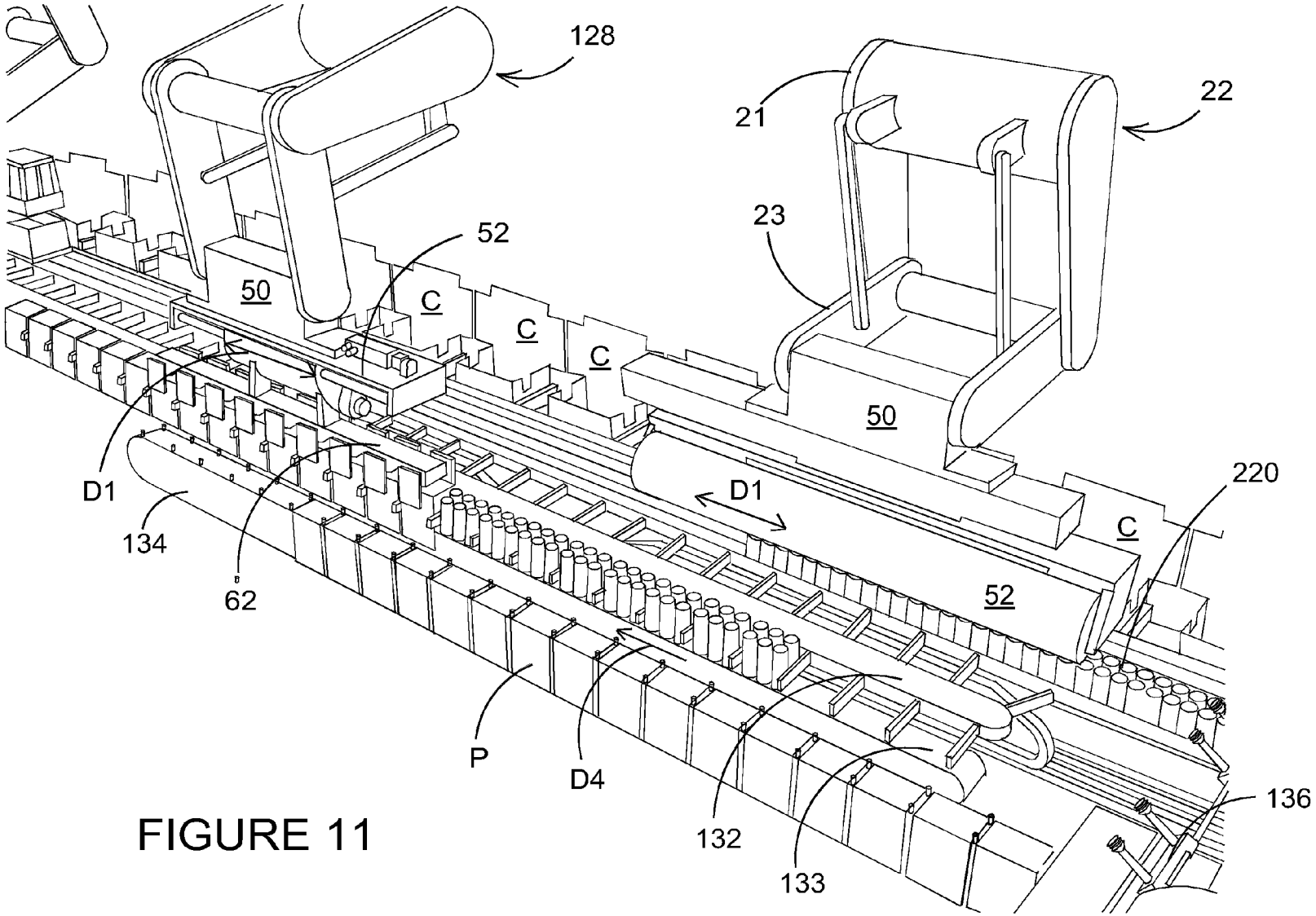
FIG. 11. is a perspective view from above of the carton filling stations of FIG. 4 and FIG. 9 to a second embodiment of the invention in a second stage of operation.

Referring now to FIG. 1 and to FIGS. 10 and 11, the packaging machine 10 can be utilised in a third mode of operation in which the hopper or magazine 126 is loaded with primary carton blanks P for forming a primary carton, rather than the inserts I described above. Preferably the primary carton blanks P form a wrap-around style carton, although other carton formats or styles known in the art are envisaged in alternative embodiments. The feeder mechanism 136 places the primary carton blanks P on the first conveyor 134.

The carton filler 22, instead of placing articles A into the cartons C on the carton conveyor 19 as described previously, places articles A onto a second conveyor 133 comprising flight bars which are coupled to an endless conveyor 132. The transferred articles A are conveyed in direction D4 which is parallel to the direction of the input conveyor 11 and the carton conveyor 19.

The carton filler 22 comprises gripper heads (not shown) which have been adapted to pick up and place six groups of six articles A arranged in arrays of 2×3. The gripper heads 54, 60 of the second carton filler 128 have been replaced with a gripper head 62 adapted to pick up and place the primary carton blanks P about the groups or articles A on the second conveyor 133.

Preferably, the primary carton blanks P are folded about the first conveyor 134 into a substantially inverted U-shaped structure whilst being conveyed on the first conveyor 134 as shown in FIGS. 10 and 11.

It will be appreciated that by folding the primary carton blanks P into an inverted U-shape the and also by picking and placing the primary carton blanks P in this shape the first conveyor 134 can be disposed in close proximity to the second conveyor 133.

The second carton filler 128 now comprises a gripper head 62 adapted to pick up and place the inverted U-shaped primary carton blanks P and place them over the groups of articles A on the second conveyor 133.

It is envisaged that the head unit of at least the carton filler 22 and second carton filler 128 would be adapted to be readily interchangeable by manufacturing interchangeable head units which have a common coupling mechanism allowing mechanical attachment of the head unit to the main body of these subsystems and also for connection of electrical power and/or hydraulic or pneumatic systems to the head units.

Again the carton filler 22 and the second carton filler 128 comprise the reciprocally moveable head unit 52 which allows items, carton blanks or articles, to be picked up from an upstream position and placed in a downstream position without the need to pause or stop the motion of either of the first or second conveyors 134, 133 respectively. Use of continuous motion allows increased throughput of the articles A.

Once the primary carton blanks P have been placed over the article groups on the second conveyor 133, assembly of the primary carton blank P is completed by folding the base of the primary carton about the base of the article group and securing it in place.

A primary grouping device 130 removes the assembled primary cartons from the second conveyor 133 and places them on an intermediate staging area 138 to form groups of primary cartons, as best shown in FIG. 1. These groups of primary cartons are then picked up by a package filling device 135 which places the primary cartons into the secondary cartons C on the carton conveyor 19.

The secondary cartons C are subsequently processed as hereinbefore described in the first and second modes of operation.

It can be appreciated that various changes may be made within the scope of the present invention, for example, the size and shape of the cartons may be adjusted to accommodate articles of differing size or shape, and groups of articles of alternative numbers and array structures. It is also envisaged that one or more of the conveyors of the packaging machine may be operated in the reverse direction to that described. It is envisaged that features described in relation to one embodiment or mode of operation may be combined with, or replace, features of the other embodiments or modes of operation. It is also envisaged in yet another embodiment of the present invention that the packaging machine may be adapted to process basket carrier or fully enclosed cartons which may be end loaded or top or bottom loaded. For example the carton hopper 126 may be filled with flat collapsed blanks for forming fully enclosed cartons. The first carton filler may be adapted to slide articles from the input stream into partially erected cartons having a tubular structure. The second carton filler may be adapted to ensure that articles are correctly aligned at the end of the tubular structure opposing the filling end. In yet a further embodiment the article manipulation device 12 may be disabled or dormant such that the input steam passes it, without interference, as shown in FIGS. 10 and 11.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The invention claimed is:

1. A packaging subsystem for application of a carton blank to one or more articles which packaging subsystem comprises a carton hopper for holding carton blanks, a feeder mechanism for removing carton blanks from the hopper and placing them on a first conveyor, a folding mechanism for folding panels of the carton blank about the first conveyor in a substantially inverted U-shape, and further comprising a transfer mechanism for picking up, and placing the folded carton blank in such a substantially inverted U-shape about one or more articles being transferred on a second conveyor.

2. A packaging subsystem according to claim 1 wherein either the first or second conveyor or both first and second conveyors are continuously moving.

3. A packaging subsystem according to claim 1 wherein the second conveyor is parallel to said first conveyor.

4. A packaging subsystem according to 1 wherein the transfer mechanism picks up a group of carton blanks in said inverted U-shape and places each blank simultaneously about a respective group of one or more articles.

5. A packaging subsystem according to claim 1 wherein the second conveyor is laterally spaced apart from the first conveyor.

6. A packaging machine comprising the subsystem claim 1 wherein the transfer mechanism applies cartons of the wrap-around style to the one or more articles.

7. A method of continuously forming a package comprising:

providing a continuous stream of carton blanks upon a first conveyor;

providing a continuous stream of articles upon a second conveyor;

folding said carton blanks about the first conveyor into an inverted U-shaped structure;

sequentially picking up at least one of said inverted U-shaped structures and placing it about one or more articles upon the second conveyor; and folding panels of the carton blank to complete construction of a carton about the group of articles to form a continuous stream of packages.

8. A method of continuously forming a package according to claim 7 wherein said carton blanks (P) are continuously moving during formation of the package.

* * * * *